United States Patent [19]

Poole

[11] 4,334,132

[45] Jun. 8, 1982

[54] SWITCH WITH SHAFT POSITIONING ARRANGEMENT

[75] Inventor: William F. Poole, Jeffersontown, Ky.

[73] Assignee: General Electric Company, Louisville, Ky.

[21] Appl. No.: 178,268

[22] Filed: Aug. 15, 1980

Related U.S. Application Data

[63] Continuation of Ser. No. 1,630, Jan. 8, 1979, abandoned.

[51] Int. Cl.[3] ..... H01H 19/58

[52] U.S. Cl. ..... 200/153 LB; 200/156

[58] Field of Search ..... 200/156, 6 BB, 42 T, 200/63 R-65, 153 LB, 321-328, 336, 155 R, 153 L; 74/527, 553

[56] References Cited

U.S. PATENT DOCUMENTS

| | | | |
|---|---|---|---|
| 445,146 | 1/1891 | Keyes | 200/63 R |
| 1,689,230 | 10/1928 | Christopher | 200/6 C |
| 2,319,503 | 5/1943 | Glogau | 200/6 BB |
| 3,050,604 | 8/1962 | Kusche | 200/155 R |
| 3,196,237 | 7/1965 | Westgate, Jr. | 200/153 L |
| 3,418,857 | 12/1968 | Klein | 74/10 R |
| 3,965,755 | 6/1976 | Rosenberg et al. | 74/10 R |
| 3,973,097 | 8/1976 | Rosenberg et al. | 200/153 L |

*Primary Examiner*—Willis Little

*Attorney, Agent, or Firm*—H. Neil Houser; Radford M. Reams

[57] ABSTRACT

A switch has a set of contacts, a rotatable actuator for operating the contacts and a rotatable shaft for positioning the actuator. The shaft extends out of the front of the switch housing and through the actuator to adjacent a rear housing opening. A mounting member is selectively positioned in any one of a number of predetermined positions in the housing and includes a first latch having a different angular position around the shaft for each mounting member position. A second latch on the shaft secures the shaft in a first rotary position until the shaft is moved axially toward the rear of the housing. Removable fasteners secure the mounting member in any of its predetermined positions. With the fasteners removed and the shaft in its rearward position, the mounting member is free to be moved to another of its predetermined positions, which moves the location of the first rotary position of the shaft. An actuator driver carried by the shaft drives the actuator upon rotation of the shaft. A coupling member couples the driver to the shaft and a locking part locks the driver to the shaft. The locking part is accessible through the rear housing opening to permit unlocking and subsequent relocking of the driver. The coupling member is so oriented in relation to the first and second latches that the driver can be coupled to the shaft and operatively interconnected to the actuator when the mounting member is in any of its predetermined positions.

4 Claims, 5 Drawing Figures

SWITCH WITH SHAFT POSITIONING ARRANGEMENT

This is a continuation of application Ser. No. 001,630, filed Jan. 8, 1979, now abandoned.

BACKGROUND OF THE INVENTION

The invention relates to an improved switch of the type shown in U.S. Pat. No. 3,965,755, and, more particularly, to a switch having an arrangement for permitting user pre-orientation of the rotatable control shaft.

The switch disclosed in U.S. Pat. No. 3,965,755 comprises a housing having supported therein a movable actuator and a rotatable selector shaft for positioning the actuator as a function of the rotational position of the shaft. An actuator driver is carried by the shaft and is operatively interconnected to the actuator to drive the same upon rotation of the driver by the shaft, the shaft and driver being axially movable relative to the actuator. Means are provided whereby the shaft cannot be rotated relative to the housing until the shaft is axially moved from a certain axial position thereof to another axial position thereof to clear the means thereby unlocking the selector shaft. The certain axial and rotational position of the selector shaft can be the "off" position of the selector shaft and the actuator can comprise a cam for operating a set of electrical contacts disposed in the housing of the control device. The housing has a latching part cooperable with a latching art of the shaft when the shaft is in a certain rotational and axial position relative to the housing whereby the shaft cannot be rotated relative to the housing until the shaft is axially moved from that certain axial position thereof to another axial position thereof to clear the latching part of the shaft from the latching of the housing and thereby unlock the selector shaft.

However, one problem with the switch of U.S. Pat. No. 3,965,755 is that it cannot be used as a replacement for a large variety of similar switches, but rather must be modified, during manufacture, to suit each replacement situation. This limitation results from the fact that the user of this switch does not have the ability to easily change the angular orientation of the control shaft relative to the housing when the device is in the "off" position. More specifically, after manufacture the "off" position of the shaft is fixed and this greatly reduces the versatility of the switch as a replacement vehicle. The reduction in versatility comes about because of the fact that the shaft is marked or keyed in some manner to a control knob to establish an "off" position and other similar switch operating positions. For this reason the shaft of the switch usually includes a flat portion at the operator end thereof. This flat portion the cooperates with a similar flat female receptacle on the control knob, which knob is imprinted with indicia to establish the "off" position and other control settings. It is thus easy to see that if older switches for a similar use have flat portions oriented in a variety of positions, such switches cannot all be replaced by a single fixed shaft switch without concurrent replacement of their associated control knobs.

Since it is uneconomical and impractical to provide the vast combinations of knobs required to solve the problem with knob replacement, the more desirable solution is to provide a switch having a user variable control shaft orientation.

OBJECTS AND SUMMARY

It is therefore a principal object of the invention to provide an improved switch arrangement of the type shown in U.S. Pat. No. 3,965,755 having a control shaft which is user pre-orientable to one of a plurality of positions.

A further object is to provide a switch having a control shaft which is presettable at one of a variety of angular orientations such of which may correspond to an "off" setting.

A further object of this invention is to provide an improved switch having one or more novel features set forth above or hereinafter shown or described.

The above objects and others are accomplished by the provision of a switch having a control shaft whose angular orientation in the "off" position (and other positions) is user selectable.

BRIEF DESCRIPTION OF THE VIEWS

DESCRIPTION OF THE PREFERRED EMBODIMENT

Since the operation of the switch is well known in the art and is described in detail in the aforementioned patent, only a brief description of its specific features, sufficient to understand the invention, will be given herein.

Figure 1:
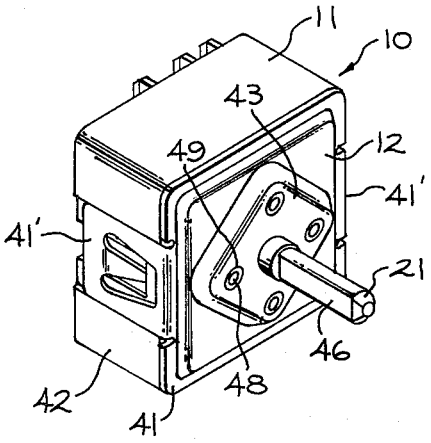
FIG. 1 is a perspective view of the improved switch device of this invention.
Figure 2:
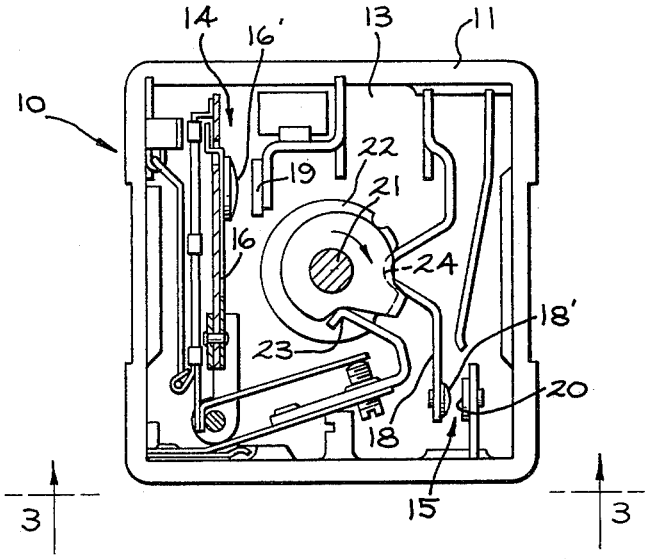
FIG. 2 is an enlarged front view of the switch device of FIG. 1 with the cover member removed and with the control device in the "off" position thereof.

Referring now to the drawings, the improved switch of this invention is generally indicated by the reference numeral 10 and comprises a housing means 11 provided with a front cover 12 and defining a chamber 13 therein, the control device 10 having one or more electrical switches 14 and 15 disposed in chamber 13 and respectively comprising movable switch blades 16 and 18 normally having their respective contacts 16' and 18' held out of contact with fixed contacts 19 and 20 when a selector shaft 21 of the control device 10 is disposed in the "off" position illustrated in FIG. 2.

The selector shaft 21 is operatively interconnected to an actuator cam 22 in a manner hereinafter described so that when the shaft 21 is turned in a clockwise direction, as shown by the arrow in FIG. 2, the actuator cam 22 is rotated relative to the housing 11 so that appropriate cam surfaces thereof operate on cam follower portions 23 and 24 of the respective switch blades 16 and 18 to move their respective contacts 16' and 18' into contact with the fixed contacts 19 and 20.

A safety locking means for the selector shaft 21 is provided so that when the same is disposed in the "off" position of FIG. 2, the shaft 21 cannot be accidentally rotated from that "off" position to the "on" position unless the control shaft 21 is unlocked from its "off" position as will be apparent hereinafter.

Figure 3:
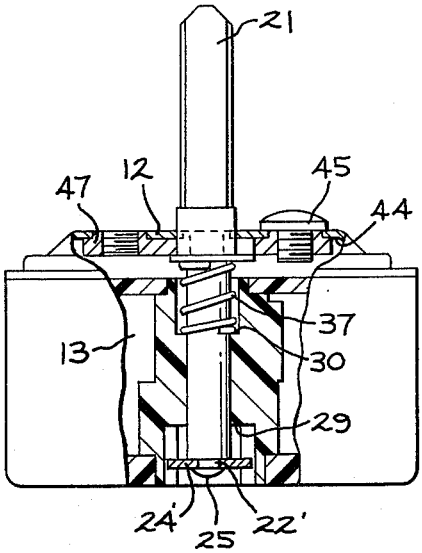
FIG. 3 is a side view of the switch device of FIG. 1 taken substantially in the direction of the arrows 3—3 of FIG. 2 with parts of the switch device being broken away for clarity.
Figure 4:
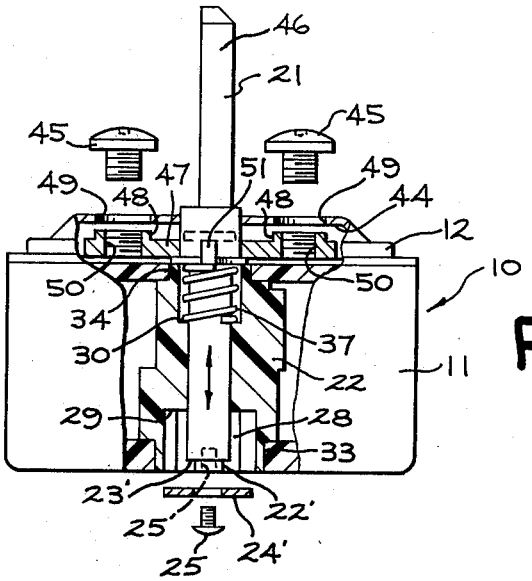
FIG. 4 is a view similar to FIG. 3 and illustrates the shaft of the switch moved rearwardly to facilitate removal and reorientation of the actuator drive element.
Figure 5:
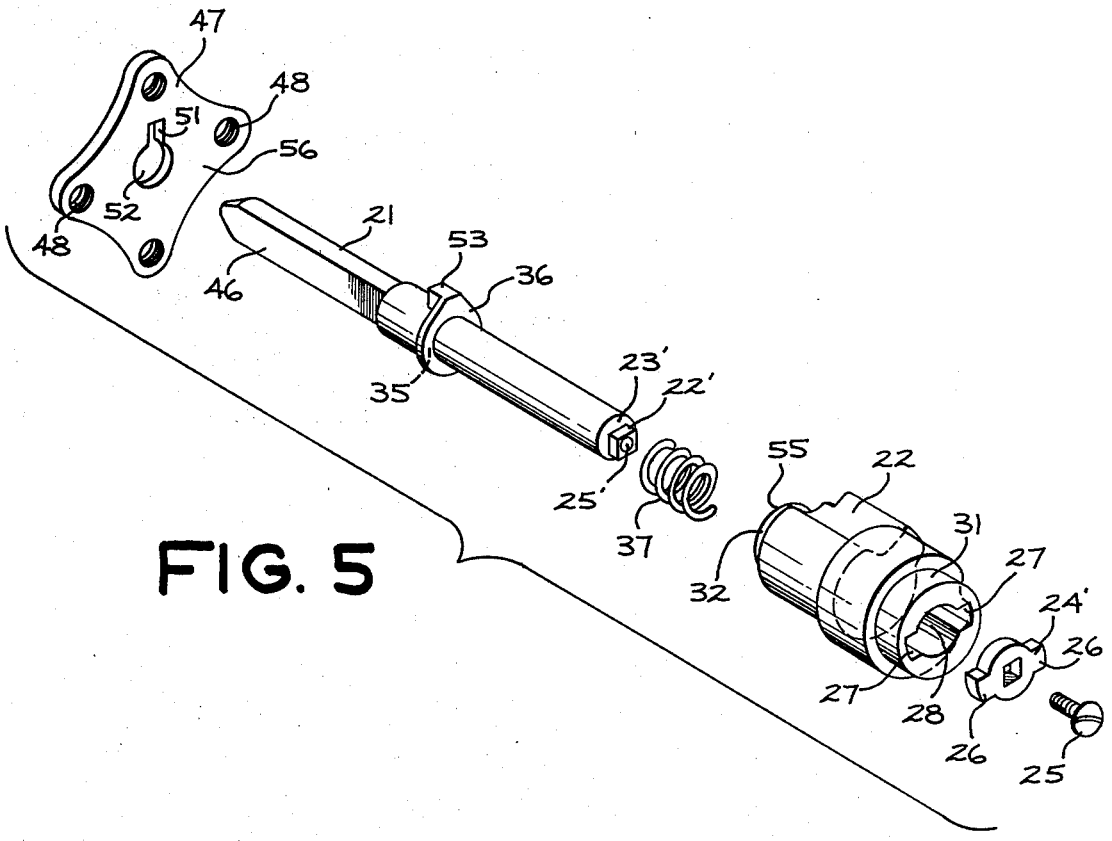
FIG. 5 is an exploded perspective view of certain parts of the switch device of FIG. 1.

As best illustrated in FIGS. 3–5, the control shaft 21 has a square shaped reduced end 22' thereof defining an annular shoulder 23' against which a washer-like actuator driver 24' having a mating square shaped opening abuts and is held thereagainst by a screw 25 which is carried in a threaded bore 25' in the end 22' of the shaft 21, as illustrated in FIGS. 4 and 5, whereby the driver 24' is fixed to the shaft 21 to rotate in unison therewith. The driver 24' is shaped to be received in a stepped bore 28 of the cam 22 and has a pair of outwardly directed, diametrically opposed driving tangs 26 for respectively being received in slots 27. In this manner, the driver 24' and shaft 21 can be moved axially relative to the actuator cam 22 from the "off" position, FIG. 2, to an "on" position (not shown), while rotational movement of the selector shaft 21 will cause the driver tangs 26 to cause like rotational movement of the actuator cam 22 when the shaft 21 is in the unlocked condition.

The stepped bore 28 passing through the actuator cam 22 defines internal shoulders 29 and 30 in the actuator cam 22.

The actuator cam 22 has a pair of bearing end surfaces 31 and 32 respectively disposed in bearing openings 33 and 34 of the housing 11 to rotatably mount the cam actuator 22 to the housing means 11 in the chamber 13 thereof with the selector shaft 21 being rotatably mounted to the cam actuator 22 in the reduced portion of the bore 28 thereof that is intermediate the shoulders 29 and 30 thereof.

The shaft 21 has another shoulder axially spaced from the annular shoulder 23' thereof as well as from the annular shoulder 30 of the cam actuator 22 when the selector shaft 21 is assembled thereto in the manner illustrated in FIG. 4. In this manner, a locking disc member 36 can be fixed on the shaft 21 to abut against the shoulder. A compression spring 37 also telescoped on the shaft 21 has one end bearing against the member 36 and the other end thereof bearing against the annular shoulder 30 of the cam actuator 22 whereby the force of the compression spring 37 continuously acts on the member 36 and, thus, on the shoulder 35 of the shaft 21 to urge it outwardly relative to the housing 11 for a purpose hereinafter described.

The housing 11 has attached thereto a metal front plate or front cover 12 that is substantially U shaped and has a base portion 41 and two leg portions 41' extending from the base for engaging opposed side walls 42 of the housing means 11 to close the chamber 13 thereof. The front cover 12 has an outside surface 43 and an inside surface 44 and is provided with a central opening through which the selector shaft 21 can project to have a suitable control knob or other selector means (not shown) fastened on the outer end 46 thereof for causing rotational and axial movement of the shaft 21 in the manner hereinafter described.

A mounting plate 47 is secured to the inside surface 44 of the front cover 12 and has four mounting extensions 48 thereon adapted to project into openings 49 formed through the front cover 12, the extensions 48 each having a threaded bore 50 passing therethrough. The plate 47 thus may be joined to the cover 12 in any one of four positions each displayed by 90° from the nearest alternative positions. The plate 47 may thus be fixed to the cover 12 in any one of four positions by passing a screw 45 into the aligned hole 49 and bore 48. The screw 45, in addition to securing the plate 47 to the cover 12, may concurrently function to mount the switch 10 to any suitable structure by passing it into the threaded bores 50 thereof and through a support panel (not shown).

The mounting plate 47 also has a recess 51 formed therein that intersects with a circular and central opening 52 therethrough whereby the shaft 21 is adapted to pass through the opening 52 of the mounting plate 47 as the opening 52 thereof is coaxially aligned with the opening of the front cover 12.

The locking disc member 36 has a latching projection 53, a portion of which projects substantially transversely out from the shaft 21 in a manner adapted to be received in the recess 51 of the mounting plate 47 to latch the shaft 21 in the axial and rotational position illustrated in FIG. 3.

The switch hereinbefore described operates as follows:

When the selector shaft 21 is disposed in the "off" position as illustrated in FIG. 2, the latching projection 53 is fully disposed in the recess 51 of the mounting plate 47 whereby the control shaft 21 is in a certain rotational and axial position relative to the housing means 11 so that the same cannot be rotated while in that axial position. In this "off" position of the control shaft 21, it can readily be seen in FIG. 2 that the cam actuator 22 is maintaining the switches 14 and 15 in an open condition thereof.

Therefore, a person cannot accidentally rotate the shaft 21 by bumping the same or the conventional control knob disposed thereon to turn the control device 10 "on" and thereby cause an accidental closing of the switches 14 and 15 thereof because in order for a person to turn the control device 10 to an "on" position, the person must grasp the shaft 21 and axially move the same in toward the housing 11 in opposition to the force of the compression spring 37 until the projection 53 clears the recess 51 of the mounting plate 47 to permit the shaft 21 to be rotated relative to the housing means 11.

If desired, the control shaft 21 can be pushed inwardly into the housing 21 until the member 36 bottoms out against the end surface 55 of the actuator arm whereby further inward axial movement of the shaft 21 is prevented.

In this manner, the operator now knows that when the shaft 21 has bottomed out against the end 55 of the actuator cam 22, he is free to turn the shaft 21 to the desired "on" position thereof to cause closing of the switches 14 and 15. Such rotational movement of the shaft 21 is accomplished even though the shaft 21 is no longer held in the axially rearward "on" position once the projection 53 has cleared the locking recess 51 and the shaft 21 has been rotated beyond a position for the projection 53 to be received in the recess 51 whereby the force of the compression spring 37 will only move the shaft 21 until its projection 53 is disposed against the inside surface 56 of the mounting plate 47 which will act as a bearing surface therefore permitting the same to slide thereon as the shaft 21 is rotated to the desired "on" position.

Thereafter, when the operator desires to turn off the switch 10, the shaft 21 is merely rotated back to the "off" position whereby the force of the compression spring 37 will drive the shaft 21 and the locking projection pin 53 frontwardly to enter the recess 51 of the mounting plate 47 and again lock the shaft 21 in the "off" position. The splined connection between the actuator driver 24' and the actuator cam 22 permits such axial movement of the shaft 21 relative thereto, as previously described.

By way of background, and as alluded to hereinbefore, in the prior art switch of this type the angular or rotational position of the shaft 21 in the "off" position was fixed during manufacture. This follows from the fact that plate 47 was welded or fixed to cover 12 which fixed the position of shaft 21 (in the "off" position) by virtue of the mating relationship between projection 53 and recess 51. By contrast the switch arrangement disclosed herein frees the plate 47 for movement with the shaft 21 to any one of four positions in which the extensions 48 and holes 49 are in alignment.

At the same time the cam 22 is permitted to remain fixed while the shaft 21 is rotated on the four positions corresponding to plate 47. This is accomplished by releasably attaching the actuator drive 24' to the shaft 21 by means of the screw 25 and threaded hole 25' in the end 22' of the shaft. The mating square configuration of the end 22' and recess in the driver 24' permits positive drive of the actuator when the screw 25 is in place.

In operation, assuming the "off" position of the switch corresponds to the flat portion 46 as shown in FIG. 4, the "off" position may be changed to correspond to a flat portion 46 which is 180° out of phase with this position as follows:

The screw 25 is first removed from the shaft 21. The actuator drive 24' is then removed from within the bore 28 of the cam 22. This latter action frees the shaft 21 from the cam 22. Now, by depressing the shaft 21 axially against the force of the spring 37 the plate 47 is moved rearwardly slightly from the inside surface of the cover 12 to permit free rotation thereof. In this position the cam 22 is held stationary by the action of the cam followers 23 and 24.

The shaft 21 is then rotated to the desired position 180° displaced from the previous position and the plate 47 is concurrently moved while maintaining the projection 53 within the recess 51. The actuator drive 24' is then reinserted within bore 28 with the square shafted end 22' being received into the corresponding square shaped recess in the actuator drive 24'. The screw 25 is then reinserted to hold the drive 24' fast to the shaft 21. Now, the shaft 21 is in a new "off" position, 180° displaced from the previous "off" position. When the shaft 21 is rotated the drive 24' operates to rotate cam 22 to thereby close switches 14 and 15 in a manner identical with that described above.

Thus, it is seen that a single switch according to the invention may be used as a replacement for a variety of similar switches having their "off" positions displaced from each other.

It should be understood that the plate 47 and locking disc 36 are required only to provide the locking feature for the switch. Thus, if the locking feature is not desired, the plate 47 and disc 36 could be eliminated from the switch without affecting the shaft pre-orienting feature of this invention. The arrangement whereby the rotatable shaft 21 is pre-orientable in different "off" positions, therefore, is achieved essentially by providing a means whereby a user of the switch may easily free the shaft 21 for rotation independent of the cam 22, this being done by means of the screw 25.

While the forms of this invention now preferred have been described and illustrated as required by the Patent Statute, it is to be understood that other forms can be utilized and still come within the scope of the appended claims.

What is claimed is:

1. A switch having a housing provided with a rotatable actuator, a set of contacts operable between open and closed positions by said actuator and a rotatable selector shaft for positioning said actuator in response to the rotational position of said shaft; said shaft extending out of the front of said housing and extending through said actuator to the rear of said housing adjacent a rear opening in said housing; a mounting member positioned in said housing; said mounting member and said housing having cooperating positioning means for selectively locating said mounting member in one of a plurality of predetermined positions spaced angularly around said shaft; said mounting member including first latching means having a different predetermined position relative to said shaft when said mounting member is in each of its plurality of positions; second latching means carried by said shaft and adapted to engage said first latching means when said shaft is in a first position to prevent rotation of said shaft until said shaft is moved axially toward the rear of said housing for disengaging said first and second latching means; removable securing means for securing said mounting member in any of its predetermined positions within said housing; axial movement of said shaft toward the rear of said housing, with said securing means removed, freeing said mounting member for movement from one to another of its predetermined positions so that the position of the first latching means and thus the first position of said shaft is moved; an actuator driver carried by said shaft adjacent the rear of said housing and operatively interconnected to said actuator to drive said actuator upon rotation of said driver by said shaft; coupling means for coupling said driver to said shaft and fastener means carried by said shaft for locking said driver to said shaft; said fastener being located adjacent said opening in the rear of said housing and accessible therethrough to permit removal of said driver from said shaft and subsequent relocking of said driver to said shaft through said opening; said coupling means being so oriented in relation to said first and second latching means that said driver can be coupled to said shaft and operatively interconnected to said actuator when said mounting member is in any of its predetermined positions.

2. The combination recited in claim 1 wherein said actuator comprises a rotatable cam carried by said housing.

3. The combination recited in claim 1 wherein said first latching means is movable to four distinct positions with respect to said housing, each of said positions being displaced by 90° from adjacent positions.

4. The combination recited in claim 3 wherein said shaft and driver have mating formations for permitting said driver to be carried by said shaft in four distinct positions relative thereto, each position displaced by 90° relative to adjacent positions.

* * * * *